US005445931A

United States Patent [19]

Yamanouchi et al.

[11] Patent Number: 5,445,931

[45] Date of Patent: Aug. 29, 1995

[54] SILVER HALIDE PHOTOGRAPHIC MATERIAL

[75] Inventors: Junichi Yamanouchi; Yutaka Tamura; Yasuyuki Takagi, all of Kanagawa, Japan

[73] Assignee: Fuji Photo Film Co., Ltd., Kanagawa, Japan

[21] Appl. No.: 283,763

[22] Filed: Aug. 3, 1994

Related U.S. Application Data

[63] Continuation of Ser. No. 66,199, May 25, 1993, abandoned.

[30] Foreign Application Priority Data

May 26, 1992 [JP] Japan ..... 4-133922

[51] Int. Cl.[6] ..... G03C 1/047

[52] U.S. Cl. ..... 430/627; 430/516; 430/529; 430/539; 430/963; 430/537; 430/635; 430/640

[58] Field of Search ..... 430/627, 963, 635, 640, 430/523, 529, 516, 536, 539, 537

[56] References Cited

U.S. PATENT DOCUMENTS

| | | | |
|---|---|---|---|
| 3,811,889 | 5/1974 | Endou et al. | 430/529 |
| 4,268,623 | 5/1981 | Sera et al. | 430/529 |
| 4,865,960 | 9/1989 | Helling et al. | 430/548 |

*Primary Examiner*—Thorl Chea

*Attorney, Agent, or Firm*—Sughrue, Mion, Zinn, Macpeak & Seas

[57] ABSTRACT

A silver halide photographic material comprising, on a support, at least one silver halide emulsion layer, which has at least one hydrophilic colloid layer (including the silver halide emulsion layer) containing a water-soluble polymer comprising a COOH-containing monomer or a salt thereof which is water-insoluble at a pH≦6 and water-soluble at a pH≧10. The photographic material is well processed by ultra-rapid processing system, displaying an excellent drying property.

13 Claims, No Drawings

SILVER HALIDE PHOTOGRAPHIC MATERIAL

This is a continuation of application Ser. No. 08/066,199, filed May 25, 1993, abandoned.

FIELD OF THE INVENTION

The present invention relates to a silver halide photographic material and, in particular, to technology for improving the drying property of the photographic material during processing and greatly reducing the generation of roller marks in the photographic material during processing with an automatic processor. Further, the invention relates to a silver halide photographic material well-suited to ultra-rapid processing.

BACKGROUND OF THE INVENTION

Recently, high-temperature rapid development of photographic materials has been popularized noticeably, and the processing time has been greatly reduced by using various kinds of automatic processors. In order to satisfactorily attain rapid processing of photographic materials, developers are required which are capable of providing sufficient sensitivity to the processed materials in a short processing time. In addition, photographic materials having a high rate of development to provide sufficient density in a short processing time and having a short drying time after rinsing are required.

A method which is generally employed in order to improve the drying property of photographic materials includes a method of first adding a sufficient amount of a hardening agent (gelatin-crosslinking agent) to the photographic material during coating in order to reduce the swelling rate of the emulsion layers and the hydrophilic colloid layers during development, fixation and rinsing, whereby the water content of the processed materials before initiation of drying is reduced. In accordance with this method, the drying time may be reduced depending upon the use of a larger amount of the hardening agent added to the photographic materials.

However, the addition of a larger amount of the hardening agent to the photographic materials causes a reduction in the swelling rate of the layers, whereby the rate of development, the sensitivity, the contrast and the covering power are lowered. Even if the rate of development of the photographic materials could be improved by this method, the rate of fixation is lowered as the photographic materials are greatly hardened, which causes various problems, such as an increase in residual silver, an increase in residual hyposulfite (hereinafter "hypo") and an increase in coloration of the processed materials due to the remaining sensitizing dyes therein. These problems have heretofore been a bar to a reduction of the processing time of photographic materials.

On the other hand, a method of elevating the developing activity of developers is known, in which the amount of the developing agent and/or the amount of the auxiliary developing agent are/is increased, the pH value of the developer is elevated, or the processing temperature is elevated. However, this method involves various drawbacks, for example, the preservability of the developers is lowered, the contrast of the processed materials is lowered and/or the processed materials are fogged even though the sensitivity is elevated.

In order to improve the above-mentioned problems, the technology of employing tabular grains has been proposed, for example, as described in U.S. Pat. Nos. 4,439,520 and 4,425,425. Also, JP-A 63-305343 and JP-A 1-77047 (the term "JP-A" as used herein means an "unexamined published Japanese patent application") disclose technology of elevating the rate of development and the ratio of sensitivity/fog by controlling the development starting point of silver halide grains having a (111) plane to the corners and/or edges and their environs of the grains. JP-A 58-111933 disclose a photographic element for radiography having an elevated covering power due to a restriction of the swelling ratio of the hydrophilic colloid layer containing tabular grains to be 200% or less, and the addition of a hardening agent to the element during processing is unnecessary. These known methods are valuable for improving the rate of development of photographic materials. However, reduction of the processing time for photographic materials with respect to developing, fixing and rinsing causes various problems, such as a decrease in photographic sensitivity and also an increase of residual silver and residual hypo. These problems can generally be attributed to a worsening in the fixation of the processed materials.

If the materials are color-sensitized with sensitizing dyes, another problem in present, that is, coloration of the processed materials due to the dyes which remain therein (residual color).

Improving photographic properties of photographic materials only by modifying the silver halide grains is naturally limitative and, after all, is based on the film property of the materials. Specifically, fixation of processed photographic material as well as residual color depends upon the thickness of the hydrophilic colloid layers constituting the material, which bars elevation of the rapid processability of the photographic materials.

In this connection, JP-A 64-73333, 64-86133, 1-105244, 1-158435 and 1-158436 disclose a means of controlling the amount of gelatin in the hydrophilic colloid layers containing silver halide emulsion layers within the range of from 2.00 to 3.50 g/m$^2$ and combining other techniques to attain ultra-rapid processability of photographic materials capable of being processed in a total processing time of from 20 seconds to less than 60 seconds. JP-A 2-68537 discloses a means of controlling the weight ratio of silver in the light-sensitive silver halide to gelatin (silver/gelatin) in the coated emulsion layer to 1.5 or more to attain ultra-rapid processability of photographic materials. JP-A 63-221341 discloses a means of preparing a photographic material by coating an emulsion layer consisting essentially of tabular silver halide grains having an aspect ratio of grain diameter to grain thickness of being 5 or more, the material having a gelatin content of from 2.00 to 3.20 g/m$^2$ and having a melting time of from 8 seconds to 45 seconds; and the material thus prepared may be processed by ultra-rapid processing with a total processing time of from 20 seconds to less than 60 seconds.

Investigating the known methods, the present inventors have found that when the gelatin content is reduced or when the ratio of silver/gelatin is elevated while the silver content is kept constant, the materials have noticeably increased scratch marks or roller marks. Scratch marks are black streaks formed on processed photographic materials due to the rubbing of films with each other or the rubbing of a film with any other substance during the handling of films. Roller marks are black spots formed on processed photographic material due to pressure of small hills or hollows of the surface of the conveying roller applied to photographic materials during processing in an automatic processor. Thus, the materials are at a practically unacceptable level. As a result, photographic products applicable to ultra-rapid processing could not be completed.

Where the total processing time of known photographic materials was 60 seconds or less, especially 40 seconds or less, with suitably apportioning of the time among the development, fixation and rinsing steps, the materials often involved problems in drying if the environment of the automatic processor had a high humidity and if the gelatin content of the materials was not 2.5 $g/m^2$ or less. However, such reduction of the gelatin content in photographic materials is unacceptable from the viewpoint of the chance for an increase of roller marks and scratch marks in the processed photographic materials.

A mentioned above, the drying property, pressure resistance and fixability (i.e., elimination of residual color due to sensitizing dyes) of photographic materials could not satisfactorily be improved merely by controlling the gelatin content.

It is well known to incorporate polymers having —COOH or its salt structure into photographic materials or to incorporate the polymers along with a hydrophilic colloid of gelatin thereinto.

For instance, JP-B 57-53587 and 57-15375 (the term "JP-B" as used herein means an "examined Japanese patent publication"), German Patent 1,745,061, JP-B 49-23827, 55-14415 and 55-15267, JP-A 48-89979, U.S. Pat. Nos. 2,279,410 and 3,791,831 and JP-B 47-28937 disclose incorporating a carboxyl group-containing polymer into a photographic material to prevent static charging of the material. However, these documents do not disclose controlling the swelling rate of the hydrophilic colloid layer of the material to promote the drying rate of the material due to incorporation of an anionic high polymer antistatic agent. In general, a large amount of an anionic antistatic agent is often incorporated into a specific hydrophilic colloid layer and a large amount of a gelatin hardening agent is often incorporated into a photographic material so as to improve the physical properties of the film. If such an anionic antistatic agent is utilized for controlling the swelling property of a processed photographic material so as to reduce the drying load of the material, as sought in the present invention, problems such as an increase of residual silver and residual hypo occur, as in the above-mentioned invention of JP-A 58-111933.

European Patent Nos. 75231 and 167081, JP-A 53-7231, 60-126644, 60-156056, 2-20861, JP-B 1-14574 and U.S. Pat. No. 4,142,894 disclose employing a carboxyl group-containing high polymer mat agent. However, a mat agent naturally results in grains having a grain size of approximately from 0.2 to 10 μm on the surface of a photographic material. When exposed to light, the agent displays its function due to the surface roughness of the material. Such coarse and large grains are not sufficient for attaining the function of controlling the swelling rate of processed photographic material, as sought by the present invention.

JP-A-2-207242 discloses incorporating a polyacrylic acid derivative into a photographic material having an anti-halation layer containing an ammonium structure-containing a high polymer mordant agent and an anionic dye so as to improve the decolorability of the anionic dye. However, there is no disclosure of controlling the swelling rate of the processed photographic material due to a —COOH group-containing polymer. In fact, the present inventors have clarified that acrylic acid homopolymers as described in JP-A-2-207242 have no effect on improving the drying property of photographic materials containing them based on the swelling rate controlling effect of photographic materials processed substantially in the absence of a hardening agent.

Polymers containing a repeating unit of an acid component which is water-insoluble at a $pH<6$ and is water-soluble at a $pH>10$, are disclosed. For example, German Patent 3,608,744 describes emulsion polymers of copolymer couplers. However, since polymers of this kind are substantially insoluble in water and alkali substances, they do not function to control the swelling rate of processed photographic materials like those mentioned above.

SUMMARY OF THE INVENTION

The first object of the present invention is to provide a silver halide photographic material which rapidly dries during processing, especially rapid processing.

The second object of the present invention is to provide a silver halide photographic material which rapidly dries during processing and which has roller marks and scratch marks reduced to a satisfactorily practical level.

The third object of the present invention is to provide a silver halide photographic material which satisfies the above-mentioned objects, has a high sensitivity, has a high covering power and is well-suited to rapid processing.

The above and other objects and advantages are attained by a silver halide photographic material comprising, on a support, at least one silver halide emulsion layer, which has at least one hydrophilic colloid layer (including the silver halide emulsion layer) containing a water-soluble polymer comprising a COOH-containing monomer or a salt thereof which is water-insoluble at a $pH \leqq 6$ and water-soluble at a $pH \geqq 10$.

The term "water-soluble" means a solubility of 10 by weight or more in water at 25° C., and the term "water-insoluble" means a solubility of 5% by weight or less in water at 25° C.

DETAILED DESCRIPTION OF THE INVENTION

Preferred embodiments of the silver halide photographic material of the invention include (I) to (IV) as follows, which will be explained in more detail below.

(I) The water-soluble polymer is at least on one side of the support coated with the silver halide emulsion layer(s), and when the photographic materila is processed with a developer and a fixer which are both substantially free of a hardening agent for 8 seconds for development at 35° C., 7 seconds for fixation at 35° C. and 7 seconds for rinsing at 20° C., the ratio of a swelling rate of the material after rinsing to a swelling rate of the material after development is 1.0 or less.

(II) When the photographic materila is processed with a developer and a fixer which are both substantially free of a hardening agent for 8 seconds for development 35° C., 7 seconds for fixation at 35° C. and 7 seconds for rinsing at 20° C., the ratio of a swelling rate of the material after rinsing to a swelling rate of the material with distilled water is 1.0 or less. The swelling rate of the material with distilled water is a conversion of the and 60% relative humidity for 16 hours and then dipped in thickness of the material which has been incubated at 40° C. distilled water having a temperature of 21° C. for 3 minutes.

In the present invention, the swelling rate after development is preferably from 100 to 400% and the swelling rate after rinsing is preferably from 90 to 300%.

(III) The ratio (polymer ratio) of the water-soluble polymer to gelatin coated on one surface of the support, which has a value of 0.01 to 0.3, is represented by the following equation:

| |
|---|
| Polymer ratio = (amount of the water-soluble polymer coated)/(amount of the water-soluble polymer coated + amount of the gelatin coated) |

(IV) The dry-to-dry processing time for developing the material from start of development to finish is 60 seconds or less.

DETAILED DESCRIPTION OF THE INVENTION

The water-soluble polymer of the present invention is explained below.

Where the polymer contains the COOH-containing monomer in the form of a neutralizable salt, it is preferably in the form of an alkali metal salt (e.g., Na or K salt) or an ammonium salt (e.g., trimethylamine salt). More preferably, it is in the form of an alkali metal salt.

Examples of hydrophobic COOH-containing monomers which are water-insoluble at a pH≦6 and water-soluble at a pH≧10, of the present invention include the following compounds.

A-1

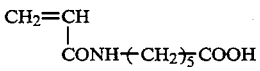

A-2

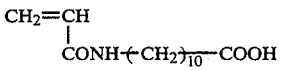

A-3

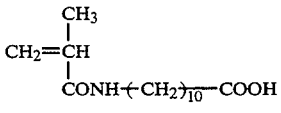

A-4

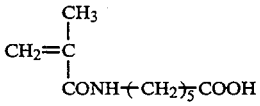

A-5

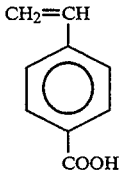

A-6

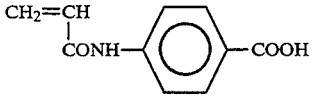

-continued

A-7

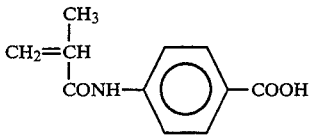

A-8

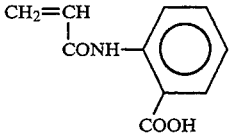

A-9

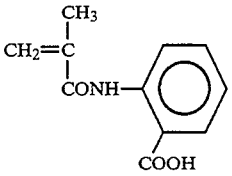

A-10

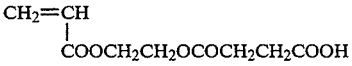

A-11

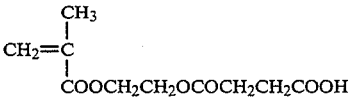

A-12

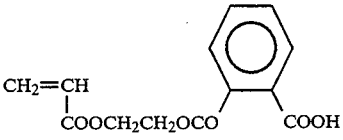

A-13

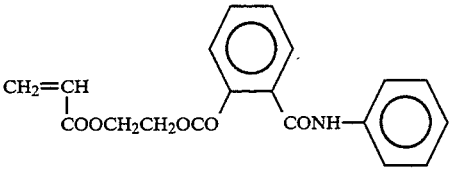

A-14

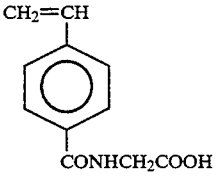

A-15

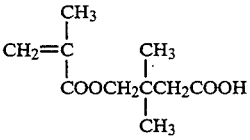

A-16

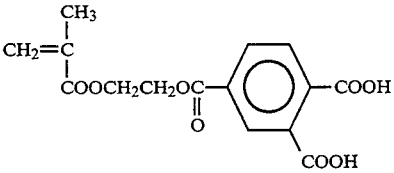

-continued

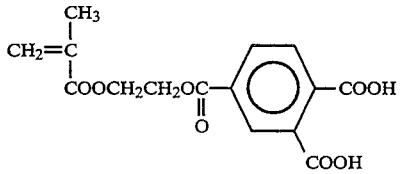

A-17

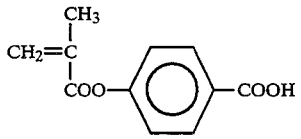

A-18

In addition to using only one hydrophobic COOH-containing monomer or a salt thereof, two or more may also be used in combination for copolymerization.

The polymer of the present invention may also be a copolymer formed by copolymerization of the hydrophobic COOH-containing monomers or their salts and other copolymerizable ethylenic unsaturated monomers.

Examples of copolymerizable ethylenic unsaturated monomers include, for example, acrylates, methacrylates, acrylamides, methacrylamides, vinyl esters, vinyl ketones, allyl compounds, olefins, vinyl ethers, N-vinylamides, vinyl-heterocyclic compounds, maleates, itaconates, fumarates and crotonates. More specifically, the monomers are hydrophobic monomers capable of forming water-insoluble homopolymers, such as methyl acrylate, ethyl acrylate, n-propyl acrylate, n-butyl acrylate, sec-butyl acrylate, octyl acrylate, diethylene glycol monoacrylate, trimethylolethane monoacrylate, 1-bromo-2-methoxyethyl acrylate, p-chlorophenyl acrylate, methyl methacrylate, ethyl methacrylate, N-tert-butylacrylamide, hexylacrylamide, octylacrylamide, ethyl vinyl ether, propyl vinyl ether, butyl vinyl ether, 2-ethylbutyl vinyl ether, vinyl acetate, vinyl propionate, ethylene, propylene, 1-butene, 1-octene, dioctyl itaconate, dihexyl maleate, styrene, methylstyrene, dimethylstyrene, benzylstyrene, chloromethylstyrene, chlorostyrene, methyl vinylbenzoate, vinyl chlorobenzoate, acrylonitrile, methacrylonitrile, vinyl chloride; and monomers capable of forming water-soluble homopolymers, such as acrylamide, N-methylacrylamide, N-ethylacrylamide, N-n-propylacrylamide, N-isopropylacrylamide, N,N-dimethylacrylamide, N-acryloylmorpholine, N-acryloylpiperidine, methacrylamide, N-methylmethacrylamide, N-methacryloylmorpholine, N-vinylpyrrolidone, N-vinylacetamide.

In addition, hydrophilic COOH-containing monomers soluble in water, even at a pH≦6, such as acrylic acid, methacrylic acid, itaconic acid or maleic anhydride as well as other anionic dissociating group-containing monomers such as 2-acrylamido-2-methylpropanesulfonic acid (and its salts), sodium p-styrenesulfonate and phosphonoxyethyl methacrylate can be used. Two or more of these monomers may be used in preparing the copolymer of the present invention.

The ratio of repeating units of the hydrophobic COOH-containing monomers in the polymer varies, depending upon the hydrophilicity/hydrophobicity of the hydrophobic COOH-containing monomers and the hydrophilicity/hydrophobicity of the copolymerized comonomers. Preferably, the ratio is from 10 to 100% by weight, more preferably from 30 to 100% by weight.

In order to effectively attain the desired control of the film swelling rate of the photographic material due to the addition of the polymer, it is preferable that the polymer itself is insoluble in water when it is not neutralized (or when it is not in the form of a salt) and that the polymer may become soluble in water when an alkali is added thereto in an amount to achieve a predetermined neutralizing ratio.

In this case, the neutralizing ratio (the ratio of carboxyl groups having a base structure to the total carboxyl groups) of the water-soluble polymer of the present invention is preferably from 30 to 100%, more preferably from 50 to 100%.

For purposes of the present invention a polymer is water-soluble if the polymer is soluble in distilled water having a temperature of 40° C. if present in an amount of 3% by weight or more.

Specific examples of compounds of the water-soluble polymer of the present invention are given below, which, however, are not limitative. The parenthesized contents are the weight percentage of the constitutive monomer components, the neutralized ratio, and the kind of the alkali used for neutralization, in this order.

P-1: A-1 homopolymer (100, neutralized ratio 80%, NaOH)

P-2: A-1/methyl methacrylate copolymer (60/40, neutralized ratio 90%, NaOH)

P-3: A-2 homopolymer (100, neutralized ratio 100%, NaOH)

P-4: A-2/acrylamide copolymer (90/10 ,neutralized ratio 90%, NaOH)

P-5: A-2/methacrylic acid copolymer (95/5, neutralized ratio 90%, NaOH)

P-6: A-2/methacrylic acid copolymer (90/10, neutralized ratio 80%, NaOH)

P-7: A-2/methacrylic acid/methyl acrylate copolymer (50/20/30, neutralized ratio 80%, NaOH)

P-8: A-4 homopolymer (100, neutralized ratio 75%, KOH)

P-9: A-6/styrene copolymer (70/30, neutralized ratio 90%, NaOH)

P-10: A-6 homopolymer (100, neutralized ratio 80%, NaOH)

P-11: A-6/ethyl methacrylate copolymer (90/10, neutralized ratio 90%, NaOH)

P-12: A-8 homopolymer (100, neutralized ratio 80%, NaOH)

P-13: A-9 homopolymer (100, neutralized ratio 80%, NaOH)

P-14: A-9/methyl methacrylate/acrylamide copolymer (60/10/30, neutralized ratio 90%, KOH)

P-15: A-9/methyl methacrylate copolymer (70/30, neutralized ratio 80%, NaOH)

P-16: A-9/2-hydroxyethyl methacrylate copolymer (50/50, neutralized ratio 80%, NaOH)

P-17: A-9/methacrylic acid/methyl methacrylate copolymer (50/20/30, neutralized ratio 80%, NaOH)

P-18: A-9/methyl methacrylate/sodium 2-acrylamido-2-methylpropanesulfonate copolymer (65/30/5, neutralized ratio 70%, NaOH)

P-19: A-10/butyl acrylate copolymer (65/35, neutralized ratio 80%, NaOH)

P-20: A-10/acrylamide copolymer (50/50, neutralized ratio 30%, NaOH)

P-21: A-12 homopolymer (100, neutralized ratio 80%, NaOH)

P-22: A-13/acrylic acid copolymer (95/5, neutralized ratio 80%, NaOH)

P-23: A-18 homopolymer (100, neutralized ratio 60%, NaOH)

The water-soluble polymer of the present invention may be prepared by a well-known method radical polymerization (for example, as described in detail in T. Ohtsu & M. Kinoshita, *Experimental Methods of Producing High Polymers*, published by Kagaku-dojin Co., 1972, pp. 124–154). A more preferred method for preparing the polymer is solution polymerization or emulsion polymerization followed by neutralization of the acid components in the resulting polymer.

Where the polymer is prepared by solution polymerization, the monomers are dissolved in a suitable solvent (for example, water, or a mixed solvent comprising water and a water-miscible solvent (e.g., methanol, ethanol, acetone, N,N-dimethylformamide), or an organic solvent alone) and then the monomers are polymerized in the solvent. Alternatively, the monomers may be polymerized by adding them to a solution. In the latter case, the solution may contain any desired auxiliary solvent, for example, the solvents mentioned above.

Neutralization of the acid components in the polymer may be effected after completion of the polymerization or, alternatively, the monomers may previously be neutralized previously.

The solution polymerization may be effected in the presence of an ordinary radical initiator (for example, an azo initiator such as 2,2'-azobis(2-amidinopropane) dihydrochloride, or a peroxide initiator such as potassium persulfate), generally at a temperature of from about 30° C. to about 100° C., preferably from about 40° C. to about 90° C.

Emulsion polymerization may be effected by emulsifying the monomers in water or in a mixed solvent comprising water and a water-miscible organic solvent (e.g., methanol, ethanol, acetone) optionally in the presence of an emulsifier, followed by polymerizing the monomers in the presence of a radical polymerization initiator generally at a temperature of from about 30° C. to about 100° C., preferably from about 40° C. to about 90° C. The amount of the water-miscible organic solvent in the mixed solvent is from 0 to 300% by volume, preferably from 0 to 150% by volume, to water.

The polymerization is effected generally in the presence of from 0.05 to 5% by weight, of a radical polymerization initiator based on the weight of the monomers to be polymerized and optionally from 0.1 to 10% by weight of an emulsifier based on the weight of the monomers to be polymerized.

The polymerization initiator includes, for example, azobis compounds, peroxides, hydroperoxides and redox catalysts, such as potassium persulfate, ammonium persulfate, tert-butyl peroctoate, benzoyl peroxide, isopropyl percarbonate, 2,4-dichlorobenzoyl peroxide, methyl ethyl ketone peroxide, cumene hydroperoxide, dicumyl peroxide, azobisisobutyronitrile, and 2,2'-azobis (2-amidinopropane) hydrochloride.

The emulsifier includes, for example, anionic, ampholytic and nonionic surfactants and water-soluble polymers. For instance, sodium laurate, sodium dodecylsulfate, sodium 1-octoxycarbonylmethyl-1-octoxycarbonylmethanesulfonate, sodium laurylnaphthalenesulfonate, sodium laurylbenzenesulfonate, sodium laurylphosphate, polyoxyethylene nonylphenyl ether, polyoxyethylene sorbitan laurylester, polyvinyl alcohol, emulsifiers and water-soluble polymers as described in JP-B 53-6190 can be used.

In effecting emulsion polymerization, factors such as the polymerization initiator, concentration, polymerization temperature and reaction time may be varied broadly and easily in accordance with the objectings of the polymerization.

Examples of methods for producing water-soluble polymers of the present invention are as follows, but the methods are not limited thereto.

Production Example 1

Production of Polymer P-3

3.60 g of N-oleyl-N-methyltauride, 100 ml of methanol, 50 ml of isopropyl alcohol and 860 ml of distilled water were put in a 2-liter three-neck flask equipped with a stirrer and a reflux condenser tube and heated at 75° C. while stirring in nitrogen stream.

A solution of 1.20 g of potassium persulfate dissolved in 50 ml of distilled water was added thereto, and a solution of 120 g of 11-acrylamidoundecanoic acid (monomer A-2) dissolved in 240 ml of methanol was added dropwise thereto at a constant rate over a period of 2 hours. After the addition, the solution was stirred for one hour at 75° C., then was heated while methanol was distilled off over a period of 3 hours.

After the solution obtained was cooled, a solution of 18.8 g of sodium hydroxide dissolved in 200 ml of distilled water was added and this solution was stirred for one hour. Then, the reaction mixture was filtered to obtain 1195 g of an aqueous solution of polymer (P-3) (having a solid content of 11.2%).

Production Example 2

Production of Polymer P-1

20 g of 6-acrylamidohexanoic acid (monomer A-1), 70 ml of ethanol and 10 ml of distilled water were put in a 300-ml three-neck flask equipped with a stirrer and a reflux condenser tube and heated at 80° C. while stirring. An initiator solution of 0.1 g of dimethyl 2,2'-azobisisobutyrate dissolved in 10 ml of ethanol was added and heated while stirring for 2 hours. Then, an initiator solution having the same composition as above was added and heated while stirring for an additional 3 hours.

After the solution obtained was cooled, a solution of 3.45 g of sodium hydroxide dissolved in 100 ml of distilled water was added and heated, and ethanol was distilled off under a reduced pressure.

The thus obtained aqueous solution was filtered to obtain 147.6 g of an aqueous solution of polymer (P-1) (having a solid content of 14.8%).

The other polymers described above may be produced by methods analogous to Production Example 1 and Production Example 2.

As a preferred embodiment of the present invention, the molecular weight of the water-soluble polymer added to the hydrophilic colloid is preferably $5\times10^3$ or more, especially preferably from $1\times10^4$ to $5\times10^6$ (as a weight average molecular weight).

The amount of the water-soluble polymer added to the photographic material of the present invention varies, depending upon the kind of the material, and is preferably from 0.01 g/m$^2$ to 2 g/m$^2$, more preferably from 0.03 g/m$^2$ to 1 g/m$^2$, most preferably from 0.05 g/m$^2$ to 0.5 g/m$^2$ based on one surface of the support.

Where the silver halide photographic material of the present invention has two or more hydrophilic colloid layers, the water-soluble polymer may be added to all the hydrophilic colloid layers, just some of the hydrophilic colloid layers, or only one of the hydrophilic colloid layers. Where the water-soluble polymer is added to two or more of the hydrophilic colloid layers, the amount added to these layers may be varied freely.

Where the water-soluble polymer is incorporated into the photographic material of the present invention, it is necessary that the polymer is dissolved in water and the resulting solution is added to the hydrophilic colloid layer(s) constituting the photographic material. In dissolving the polymer in water, employment of suitable alkali substances and salts is preferred. If desired, a water-miscible organic solvent (for example, acetone, methanol, ethanol, acetonitrile, dimethylsulfoxide, dimethylacetamide) may be employed as an auxiliary solvent for the dissolution.

Gelatin is preferred as the hydrophilic colloid forming the hydrophilic colloid layer containing the water-soluble polymer of the present invention. Examples of the gelatin include a lime-processed gelatin, an acid-processed gelatin and an enzyme-processed gelatin. In addition, hydrolysates and enzyme-decomposed products of gelatin can also be used.

Also preferred are other hydrophilic colloids other than gelatin as a mixture thereof with gelatin.

Usable hydrophilic colloids include, for example, proteins such as gelatin derivatives, graft polymers of gelatin and other high molecular weight polymers, albumin and casein; cellulose derivatives such as hydroxyethyl cellulose, carboxymethyl cellulose and cellulose sulfate esters; saccharide derivatives such as sodium alginate, dextran and starch derivatives; and other various synthetic high molecular weight polymer substances of homopolymers or copolymers such as polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole. A combination of gelatin and dextran or polyacrylamide having a mean molecular weight of 50,000 or less is preferred.

The methods as described in JP-A 63-68837 and 63-49641 can be applied to the present invention.

Where the water-soluble polymer of the present invention is mixed with a hydrophilic binder and coated on a support to prepare a photographic material, the pH value of the coating mixture is preferably from 6.0 to 9.0, more preferably from 6.5 to 8.0, most preferably from 7.0 to 7.5 when the mixture is to form a non-light-sensitive layer; and the pH value is preferably from 5.0 to 8.0, more preferably from 5.5 to 7.0, most preferably from 5.8 to 6.5 when the mixture is to form a silver halide emulsion layer.

The ratio of the water-soluble polymer to the hydrophilic colloid (polymer content ratio) in the photographic material of the present invention is not specifically limited but, as described above, the ratio is preferably from 0.01 to 0.3, more preferably from 0.03 to 0.2, according to the following equation.

Polymer ratio =
(amount of the water-soluble polymer coated)/(amount of the water-soluble polymer coated + amount of hydrophilic colloid coated)

The swelling rate of a developed photographic material, the swelling rate of a processed and rinsed photographic material and the swelling rate of a non-processed photographic material with distilled water, as discussed above, are represented by the following equations, respectively.

A. Swelling rate after development =
{((thickness of coated layer after development) − (thickness of coated layer of original (non-processed) photographic material))/(thickness of coated layer of original (non-processed) photographic material)} × 100 (%)
B. Swelling rate after rinsing =
{((thickness of coated layer after rinsing) − (thickness of coated layer of original (non-processed) photographic material))/(thickness of coated layer of original (non-processed) photographic material)} × 100 (%)
C. Swelling rate with distilled water =
{((thickness of coated layer of photographic material as dipped in distilled water) − (thickness of coated layer of original (non-dipped) photographic material))/(thickness of coated layer of original (non-dipped) photographic material)} × 100 (%)

The thickness of the coated layer of the photographic material after development indicates the thickness of the coated layer of a photographic material when dipped in a developer having a temperature of 35° C. for 8 seconds.

The thickness of the coated layer after rinsing. indicates the thickness of the coated layer of a photographic material as processed in accordance with a continuous procedure of development, fixation and rinsing in this order, comprising a development step at a temperature of 35° C. for 8 seconds, a fixation step at a temperature of 35° C. for 7 seconds and a rinsing step at a temperature of 20° C. for 7 seconds.

The thickness of the coated layer of the photographic material when dipped in distilled water indicates the thickness of the coated layer of the same when dipped in distilled water having a temperature of 21° C. for 3 minutes.

The photographic material employed for measurement of the swelling rates is incubated under the conditions of a temperature of 40° C. and a relative humidity (RH) of 60% for 16 hours.

Measurement of the thickness of the coated layer under the defined conditions to obtain the swelling rates can be accomplished by the method described in Example 12 of U.S. Pat. No. 3,841,872.

The developer and fixer substantially free of a hardening agent, as referred to herein, means a developer and fixer substantially free of a compound which is a hardening agent as understood in the photographic field, for example, those having a hardening agent in an amount of 100 mg or less, particularly 30 mg or less. Examples include RD-10 (produced by Fuji Photo Film Co., Ltd.) as the developer and RF-10 (produced by Fuji Photo Film Co., Ltd.) as the fixer.

In accordance with the present invention, the ratio of the swelling rate after rinsing to that after development may be 1.0 or less. This means that the drying property of the processed photographic material of the present invention has been greatly improved without retarding rapid developability.

Also, in accordance with the present invention, the ratio of the swelling rate after rinsing to the swelling rate with distilled water may be 1.0 or less. This means that the drying property of the processed photographic material of the present invention has been greatly improved without retarding rapid developability and processability.

The photographic material of the present invention, which contains a water-soluble polymer or copolymer, as described above, is suitable for rapid processing. In particular, it is suitable for rapid processing where the dry-to-dry processing time is 60 seconds or less, more preferably 45 seconds or less, most preferably 38 seconds or less, with the preferred lower limit being 10 seconds. The dry-to-dry processing time means the time from the beginning of dipping the top end of the photographic material to be processed in the developer tank to the finish of taking out the top end of the same from the drying zone.

The photographic material of the present invention may have at least one light-sensitive silver halide emulsion layer on one surface of the support or on each of the both surfaces of the support.

The photographic material of the present invention may optionally have, in addition to the light-sensitive silver halide emulsion layer(s), any other hydrophilic colloid layer. Preferably, it has a protective layer.

In the photographic material of the present invention, the amount of .gelatin coated as a hydrophilic binder is not specifically limited, but preferably is from 1.5 g/m$^2$ to 4.5 g/m$^2$, more preferably from 1.8 g/m$^2$ to 3.6 g/m$^2$, based on one surface of the material.

The swelling rate of the photographic material of the present invention with distilled water may freely be controlled by varying the amount of the hardening agent in the material. The swelling rate of the material with distilled water is, though not specifically limited, preferably 200% or more, more preferably from 200 to 320%, in view of the problem of the residual silver and residual hypo accompanied by rapid processing of the material and the problem of residual color of color-sensitized materials due to the sensitizing dyes incorporated into the material.

Next, silver halide emulsion grains preferably employed in the present invention are explained below.

The grains preferably have a grain size of 0.4 μm or more, more preferably from 0.5 to 2.0 μm, as a mean grain size corresponding to the sphere having the same volume as the grain. The grain size distribution of the grains is preferably narrower.

The silver halide grains in the emulsion of the photographic material of the present invention may have a regular crystalline morphology such as cubic grains or octahedral grains or an irregular crystalline morphology such as spherical grains, tabular grains or potato-like grains. The emulsion may have a mixture of various silver halide grains of various crystalline forms.

The silver halide composition of the grains is preferably silver iodobromide, which has a high sensitivity.

The silver halide grains of the present invention may contain silver chloride in an amount which would not influence the photographic property of the grains. Desirably, the grains have no silver chloride.

The silver halide emulsion of the present invention may be either a monodispersed emulsion or a polydispersed emulsion, and either is preferably employed.

The silver halide emulsion of the present invention may be a core/shell monodispersed emulsion, which is described, for example, in JP-A 54-48521.

Tabular silver halide grains having an aspect ratio of grain diameter/grain thickness of 5 or more are preferably employed in the present invention. This type of tabular grain is described in *Research Disclosure,* Vol. 225, Item 22534, pp. 20–58 (January, 1983) and in JP-A 58-127921 and JP-A 58-113926.

The tabular grains used in the present invention, can be prepared by methods known in the photographic field and a combination of these methods may be used.

Additives useful in the photographic material of the present invention are not specifically limited and can include, for example, those described in the following parts of JP-A-2-68539, JP-A-2-103037 and JP-A-2-115837.

| Additives | Pertinent Part of JP-A-2-68539, 2-103037 and 2-115837 |
|---|---|
| 1. Silver halide emulsions and methods of preparing them | JP-A 2-68539: Page 8, right bottom column, line 6 from below, to page 10, right top column, line 12. |
| 2. Chemical sensitization | Ibid.: Page 10, from right top column, line 13, to left bottom column, line 16. |
| 3. Antifoggants, stabilizers | Ibid.: Page 10, left bottom column, line 17, to page 11, left top column, line 7; Page 3, left bottom column, line 2, to page 4, left bottom column. |
| 4. Spectral sensitizing dyes | Ibid.: Page 4, right bottom column, line 4, to page 8, right bottom column. |
| 5. Surfactants, antistatic agents | Ibid.: Page 11, left top column, line 14, to page 12, left top column, line 9. |
| 6. Mat agents, lubricants, plasticizers | Ibid.: Page 12, from left top column, line 10, to right top column, line 10; Ibid.: Page 14, from left bottom column, line 10, to right bottom column, line 1. |
| 7. Hydrophilic colloids | Ibid.: Page 12, from right top column, line 11, to left bottom column, line 16. |
| 8. Hardening agents | Ibid.: Page 12, left bottom column, line 17, to page 13, right top column, line 6. |
| 9. Supports | Ibid.: Page 13, right top column, lines 7 to 20. |
| 10. Dyes, mordant agents | Ibid.: Page 13, left bottom column, line 1, to page 14, left bottom column, line 9. |
| 11. Development and processing | JP-A 2-103037: Page 10, right top column, line 7, to page 19, left bottom column, line 15; JP-A 2-115837: Page 3, right bottom column, line 5, to page 6, right top column, line 10. |

The present invention will be explained in more detail by way of the following examples, which, however, are not intended to restrict the scope of the present invention.

EXAMPLE 1

Preparation of emulsion A-1:

4.5 g of potassium bromide, 20.6 g of gelatin and 2.5 cc of a 5% aqueous solution of the thioether $HO(CH_2)_2S(CH_2)_2S(CH_2)_2OH$ were added to one liter of water in a container, which was kept at 60° C. Then 37 cc of an aqueous solution of silver nitrate (silver nitrate content: 3.43 g) and 33 cc of an aqueous solution containing 2.97 g of potassium bromide and 0.363 g of potassium iodide were added, with stirring, by a double jet method. Next, an aqueous solution of 0.9 g of potassium bromide was added thereto, and the reaction mixture was heated up to 70° C. Then, 53 cc of a solution of silver nitrate (silver nitrate content: 4.90 g) was added thereto over a period of 13 minutes. 15 cc of 25% aqueous ammonia was added thereto. The mixture was physically ripened at the temperature for 20 minutes, and 14 cc of 100% acetic acid solution was added thereto. Subsequently, an aqueous solution of 133.3 g of silver nitrate and an aqueous solution of potassium bromide were added thereto, at a pAg of 8.5, by a controlled double jet method over a period of 35 minutes. Next, 10 cc of 2N potassium thiocyanate solution and 0.05 mol %, based on the total silver amount, of fine AgI grains having a diameter of 0.07 μm were added thereto. The mixture was physically ripened for 5 minutes at the temperature, and then cooled to 35° C. Thus, monodispersed tabular grains were obtained, having a total silver iodide content of 0.31 mol %, a mean projected area diameter of 1.10 μm, a thickness of 0.165 μm and a fluctuation coefficient of diameter of 18.5%.

Soluble salts were removed from the emulsion by flocculation. The emulsion was heated again up to 40° C., and 30 g of gelatin, 2.35 g of phenoxyethanol and, as a thickener, 0.8 g of sodium polystyrenesulfonate were added thereto. The resulting emulsion was adjusted to have a pH of 5.90 and a pAg of 8.25 with sodium hydroxide and silver nitrate solution.

The emulsion was then chemically sensitized with stirring at 56° C.

That is, 0.043 mg of thiourea dioxide was added to the emulsion, which was then maintained for 22 minutes in order to achieve reduction sensitization. Next, 20 mg of 4-hydroxy-6-methyl-1,3,3a,7-tetrazaindene and 500 mg of sensitizing dye (I-1):

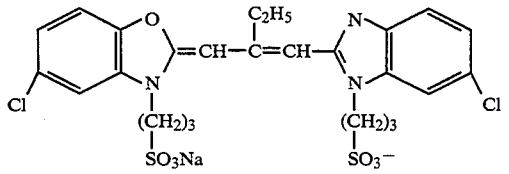

were added thereto. Then, 0.83 g of calcium chloride was added thereto. Subsequently, 1.3 mg of sodium thiosulfate, 2.7 mg of the following selenium compound:

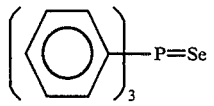

and 2.6 mg of chloroauric acid and 90 mg of potassium thiocyanate were added thereto. After 40 minutes, the mixture was cooled to 35° C.

Accordingly, emulsion (A-1) was prepared.

Preparation of water-soluble polymers of the invention:

Water-soluble polymers of the invention were prepared in accordance with the production examples described above and are shown in Table 1 below.

Preparation of coating liquid for emulsion layer:

The following chemicals were added to emulsion (A-1) to form a coating liquid, the amounts of the chemicals are per mol of silver halide of the emulsion.

| | |
|---|---|
| 2,6-Bis(hydroxyamino)-4-diethylamino-1,3,5-triazine | 72 mg |
| Gelatin<br>The total amount of gelatin, including gelatin in the surface protective layer mentioned below, is shown in Table 1 below. | |
| Trimethylol propane | 9 g |
| Sodium polystyrenesulfonate | 0.6 g |
| Water-soluble polymer of the invention | Shown in Table 1. |
| Hardening agent 1,2-bis(vinylsulfonylacetamido)ethane<br>Amount sufficient to achieve swelling rate with distilled water shown in Table 2. | |
| 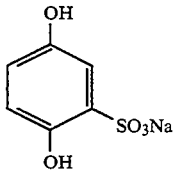 | 10.9 g |

Preparation of coating liquid for surface protective layer:

A coating liquid for coating a surface protective layer was prepared, comprising the components mentioned below.

| | |
|---|---|
| Gelatin<br>The total amount of gelatin, including gelatin in the emulsion layer mentioned above, is shown in Table 1 below. | |
| 4-Hydroxy-6-methyl-1,3,3a,7-tetrazaindene | 0.15 g/m$^2$ |
| 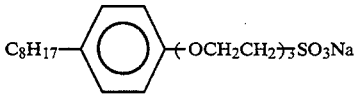 | 0.013 g/m$^2$ |
| $C_{16}H_{33}O(CH_2CH_2O)_{10}H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)(CH_2CH_2O)_{15}H$ | 0.003 g/m$^2$ |
| $C_8F_{17}SO_2N(C_3H_7)(CH_2CH_2O)_4(CH_2)_4SO_3Na$ | 0.001 g/m$^2$ |
| Polymethyl methacrylate (mean grain size: 3.7 μm) | 0.087 g/m$^2$ |
| Proxel (adjusted to have pH of 7.4 with NaOH) | 0.0005 g/m$^2$ |
| Aqueous solution of water-soluble polymer of the invention | Shown in Table 1 |

Preparation of support:

(1) Preparation of dye dispersion D-1 for subbing layer:

The following dye was milled by a ball mill by the method described in JP-A 63-197943.

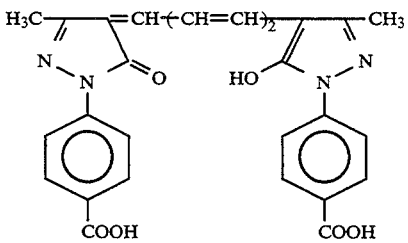

That is 434 ml of water and 791 ml of a 6.7% aqueous solution of surfactant Triton X-200 (TX-200) were put in a 2-liter ball mill. 20 g of the dye was added to the solution. 400 ml of zirconium oxide beads (diameter: 2 mm) were added to the ball mill. The content was milled for 4 days. Then, 160 g of 12.5% gelatin was added thereto. After being defoamed, the zirconium oxide beads were removed by filtration. The thus obtained dye dispersion was observed and the grain size of the milled dye grains had a broad dispersion between 0.05 μm and 1.15 μm in diameter and the mean grain size of was 0.37 μm.

By centrifugation, large dye grains having a grain size of 0.9 μm or more were removed from the dispersion.

Thus, dye dispersion (D-1) was prepared.

(2) Preparation of support:

A biaxially stretched polyethylene terephthalate film having a thickness of 183 μm was subjected to corona-discharging and then coated with a first coating liquid having the composition described below by a wire bar coater, the coated amount being 5.1 cc. The resulting film was then dried at 175° C. for one minute.

Next, the opposite surface of the film was coated with the same first coating liquid. Thus, the both surfaces of the film were coated with the first subbing layer. The polyethylene terephthalate film contained 0.04% by weight of a dye having the following structure.

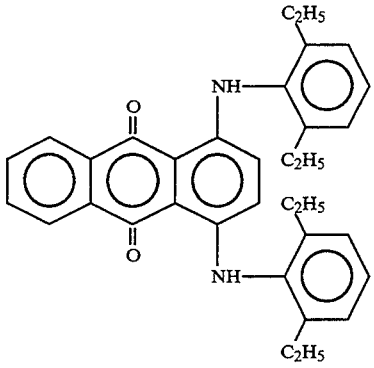

| Composition of the first coating liquid: | |
|---|---|
| Butadiene-styrene copolymer latex (solid content 40%; butadiene/styrene = 31/69 by weight) | 79 cc |
| 4% Aqueous solution of 2,4-dichloro-6-hydroxy-s-triazine sodium salt | 20.5 cc |
| Distilled water | 900.5 cc |
| (The latex contained the following compound, as an emulsifying and dispersing agent, in an amount of 0.4% by weight based on the solid content.) | |

$nC_6H_{13}OOCCH_2$
|
$nC_6H_{13}OOCCH—SO_3Na$

A second coating liquid having the composition mentioned below was coated separately on the first subbing layer of both surfaces of the film, by a wire bar coater, the amounts of the respective components are described below. The thus coated film was then dried at 150° C.

| Composition of second coating liquid: | |
|---|---|
| Gelatin | 160 mg/m$^2$ |
| Dye dispersion (D-1) | 26 mg/m$^2$ as solid dye content |

-continued

| Composition of second coating liquid: | |
|---|---|
| 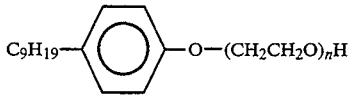 (n = 8.5) | 8 mg/m$^2$ |
| 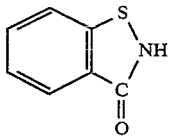 | 0.27 mg/m$^2$ |
| Mat agent (polymethyl methacrylate grains having a mean grain size of 5 μm) | 2.5 mg/m$^2$ |

Preparation of coated photographic material samples:

The above-described emulsion layer and surface protective layer were coated on both surfaces of the prepared support by co-extrusion. The silver amount coated on one surface was 1.75 g/m$^2$. The coated gelatin amount, the coated water-soluble polymer amount and the swelling rate of the coated sample were adjusted as indicated in Table 2 below, by varying the amount of gelatin and the amount of the hardening agent added to the emulsion layer. Accordingly, coated photographic material samples Nos. 101 to 123 were prepared.

Evaluation of photographic property of coated samples:

Both surfaces of each of the coated samples were exposed to light for 0.05 seconds (from both sides), using X-ray Ortho-screen HR-4 (manufactured by Fuji Photo Film Co., Ltd.). After exposure, the samples were then processed in an automatic processor under the conditions described below. The sensitivity of each sample was measured. The sensitivity was represented by a reciprocal of the exposure amount giving a density of 1.0, as a relative sensitivity, based on a sensitivity of 100 for sample No. 102.

Conditions of development:

Automatic Processor:

FPM-9000 Model, manufactured by Fuji Photo Film Co., Ltd.

Developer:

RD-10, produced by Fuji Photo Film Co., Ltd.

Fixer:

RF-10, produced by Fuji Photo Film Co., Ltd.

Processing Speed:

45 seconds for dry-to-dry processing

The processing temperatures and the amounts of the developer and fixer replenished are described below.

| Step | Temperature | Amount replenished |
|---|---|---|
| Development | 35° C. | 22 ml/10 × 12 inch |
| Fixation | 32° C. | 30 ml/10 × 12 inch |
| Rinsing | 25° C. | 3 liters/min |
| Drying | 45° C. | |

Evaluation of resistance to roller marks:

Each of the photographic material samples Nos. 101 to 123 was cut to a size of 30.5×25.4 cm, and one surface was exposed to a light from a light source having a color temperature of 5400° K., whereupon the exposure time was varied so that the density of all the exposed samples could be uniformly 1.0, including the base density, for evaluation of resistance of roller marks of each sample. The exposed samples were then processed under the conditions described below, and roller marks (black spots), if any, formed on each of the processed samples were checked. The samples were evaluated for resistance of roller marks, in accordance with the following criteria.

A: Almost no roller marks formed.

B: Some roller marks formed, but negligible.

C: Roller marks formed, but the sample is acceptable for practical use.

D: Many roller marks formed and the density was uneven. The sample is not acceptable for practical use.

For processing, an automatic processor of RN Model manufactured by Fuji Photo Film Co., Ltd. was used, where the dry-to-dry processing time was 90 seconds. The processing temperatures and the amounts of the developer and fixer replenished are described below.

| Step | Temperature | Amount replenished |
|---|---|---|
| Development | 35° C. | 22 ml/10 × 12 inch |
| Fixation | 32° C. | 30 ml/10 × 12 inch |
| Rinsing | 25° C. | 3 liters/min |
| Drying | 45° C. | |

Compositions of the developer and fixer used are described below.

| Developer: | |
|---|---|
| Potassium sulfate | 40 g |
| Trisodium hydroxyethylethylenediamine-triacetate | 8 g |
| 1,4-Dihydroxybenzene | 28 g |
| Boric acid | 10 g |
| 5-Methylbenzotriazole | 0.04 g |
| 1-Phenyl-5-mercaptotetrazole | 0.01 g |
| Sodium metabisulfite | 5 g |
| Acetic acid (90%) | 13 g |
| Triethylene glycol | 15 g |
| 1-Phenyl-3-pyrazolidone | 1.2 g |
| S-Nitroindazole | 0.2 g |
| Glutaraldehyde | 2 g |

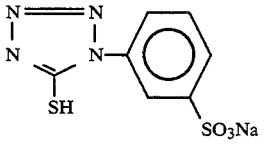

34 mg

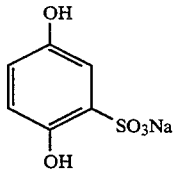

10.8 g

| | |
|---|---|
| Disodium ethylenediaminetetra-acetate | 2.0 g |
| Potassium bromide | 4.0 g |
| 5-Nitrobenzimidazole | 1.0 g |
| Water to make | 1 liter |
| Potassium hydroxide to make | pH of 10.50 |
| Fixer | |
| Sodium thiosulfate 5-hydrate | 45 g |
| Disodium ethylenediaminetetra-acetate | 0.5 g |
| Ammonium thiosulfate | 150 g |
| Sodium sulfite anhydride | 8 g |
| Potassium acetate | 16 g |
| Aluminium sulfate 10 to 18-hydrate | 27 g |
| Sulfuric acid (50 wt. %) | 6 g |
| Citric acid | 1 g |
| Boric acid | 7 g |
| Glacial acetic acid | 5 g |

-continued

| | |
|---|---|
| Water to make | 1 liter |
| Glacial acetic acid to make | pH of 4.0 |

Evaluation of drying property:

The same developer and fixer used for processing the samples for evaluation of the photographic property were used.

SRX-501 Model (manufactured by Konica Co.) was used as an automatic processor but was modified to have an elevated film conveying speed to give a dry-to-dry processing time of 30 seconds. Three liters/min of rinsing water was applied to the processor only during the time while the film being processed was passing through the processor, and application of the rinsing water to the processor was stopped during all other times.

The processing temperatures and the amounts of the developer and fixer replenished are as follows:

| Step | Temperature | Amount replenished |
|---|---|---|
| Development | 35° C. | 22 ml/10 × 12 inch |
| Fixation | 32° C. | 30 ml/10 × 12 inch |
| Rinsing | 20° C. | 3 liters/min |
| Drying | 55° C. | |

Each photographic material sample of a quarter size (10×12 inch) was continuously processed under the above-described conditions, whereupon the drying property of each sample was checked by usual evaluation based on the following criteria.

The film sample was continuously processed in the processor with the short side thereof in the conveying direction. The results obtained are shown in Table 2 below.

Visual evaluation of drying property of processed film sample:

A: After 30 sheets of film were processed, the film was taken out from the processor while it was warm and dry. The processed films had no problem.

B: After 30 sheets of film were processed, the film was completely dry. When the film was touched with the fingers, the temperature of it was almost the same as that of the film left under room temperature.

C: After 30 sheets of film were processed, the film was somewhat cold but the continuously processed film did not adhere to others. This is a practically acceptable level.

D: After 30 sheets of film were processed, the film was wet and was not dried. The processed films adhered to each other.

Measurement of swelling rate:

The swelling rate of each photographic material sample was calculated by the method mentioned below. RD-10 (produced by Fuji Photo Film Co., Ltd.) was used as a developer. RF-10 (produced by Fuji Photo Film Co., Ltd.) was used as a fixer. City water was used as the rinsing water. The swelling rate of each sample in each processing step was calculated on the basis of the equations preciously described. Each sample was dipped in distilled water having a temperature of 21° C. for 3 minutes, and the swelling rate with distilled water was calculated on the basis of the equation described above. The results obtained are shown in Table 2 below.

TABLE 1

| Photographic Material Sample | Water-soluble Polymer of the Invention | Amount of Water-soluble Polymer ($g/m^2$) | | Amount of Gelatin ($g/m^2$) | |
|---|---|---|---|---|---|
| | | Surface Protective Layer | Emulsion Layer | Surface Protective Layer | Emulsion Layer |
| 101 (Comparison) | No | — | — | 1.17 | 1.23 |
| 102 (Comparison) | No | — | — | 1.17 | 1.53 |
| 103 (Comparison) | No | — | — | 1.17 | 1.73 |
| 104 (Invention) | P-3 | 0.027 | — | 1.143 | 1.53 |
| 105 (Invention) | P-3 | 0.180 | — | 1.062 | 1.53 |
| 106 (Invention) | P-3 | 0.324 | — | 0.846 | 1.53 |
| 107 (Invention) | P-3 | 0.540 | — | 0.630 | 1.53 |
| 108 (Invention) | P-3 | 0.540 | 0.270 | 0.630 | 1.26 |
| 109 (Invention) | P-5 | 0.027 | — | 1.143 | 1.53 |
| 110 (Invention) | P-5 | 0.108 | — | 1.062 | 1.53 |
| 111 (Invention) | P-5 | 0.324 | — | 0.846 | 1.53 |
| 112 (Invention) | P-5 | 0.540 | — | 0.630 | 1.53 |
| 113 (Invention) | P-5 | 0.540 | 0.270 | 0.630 | 1.26 |
| 114 (Invention) | P-1 | 0.270 | — | 0.90 | 1.53 |
| 115 (Invention) | P-3 | 0.270 | — | 0.90 | 1.53 |
| 116 (Invention) | P-10 | 0.270 | — | 0.90 | 1.53 |
| 117 (Invention) | P-11 | 0.270 | — | 0.90 | 1.53 |
| 118 (Invention) | P-3 | — | 0.270 | 1.17 | 1.36 |
| 119 (Invention) | P-5 | — | 0.270 | 1.17 | 1.36 |
| 120 (Comparison) | polyacrylic acid | 0.270 | — | 1.143 | 1.53 |
| 121 (Comparison) | polyacrylic acid | 0.324 | — | 0.846 | 1.53 |
| 122 (Comparison) | polyacrylic acid | 0.540 | 0.270 | 0.630 | 1.26 |
| 123 (Comparison) | polyacrylic acid | — | 0.270 | 1.17 | 1.36 |

TABLE 2

| Photographic Material Sample | Swelling Rate with Distilled Water (%) | Swelling Rate after Development (%) | Swelling Rate after Rinsing (%) | Sensitivity | Resistance to Roller Marks | Drying Property |
|---|---|---|---|---|---|---|
| 101 (Comparison) | 230 | 225 | 245 | 110 | D | C |
| 102 (Comparison) | 230 | 225 | 245 | 100 | C | D |
| 103 (Comparison) | 230 | 225 | 250 | 95 | B | D |
| 104 (Invention) | 230 | 230 | 225 | 100 | B | B |
| 105 (Invention) | 230 | 230 | 220 | 103 | B | A |
| 106 (Invention) | 230 | 230 | 210 | 110 | A | A |
| 107 (Invention) | 230 | 240 | 190 | 115 | A | A |
| 108 (Invention) | 230 | 255 | 160 | 125 | A | A |
| 109 (Invention) | 230 | 235 | 225 | 102 | B | B |
| 110 (Invention) | 230 | 235 | 220 | 102 | B | A |

TABLE 2-continued

| Photographic Material Sample | Swelling Rate with Distilled Water (%) | Swelling Rate after Development (%) | Swelling Rate after Rinsing (%) | Sensitivity | Resistance to Roller Marks | Drying Property |
|---|---|---|---|---|---|---|
| 111 (Invention) | 230 | 245 | 205 | 112 | A | A |
| 112 (Invention) | 230 | 255 | 185 | 117 | A | A |
| 113 (Invention) | 230 | 265 | 160 | 127 | A | A |
| 114 (Invention) | 230 | 230 | 205 | 110 | A | A |
| 115 (Invention) | 230 | 230 | 210 | 112 | A | A |
| 116 (Invention) | 230 | 230 | 205 | 110 | A | A |
| 117 (Invention) | 230 | 230 | 210 | 112 | A | A |
| 118 (Invention) | 230 | 235 | 200 | 115 | A | A |
| 119 (Invention) | 230 | 235 | 195 | 117 | A | A |
| 120 (Comparison) | 230 | 225 | 250 | 100 | C | D |
| 121 (Comparison) | 230 | 225 | 260 | 100 | C | D |
| 122 (Comparison) | 230 | 225 | 270 | 100 | C | C |
| 123 (Comparison) | 230 | 225 | 300 | 100 | C | C |

As shown in Table 2 above, photographic material sample No. 101 had poor resistance to roller marks, and is not suitable on a practical level. Photographic material samples Nos. 102 and 103 had a poor drying property and are not durable for practical use when applied to an ultra-rapid processing system. In contrast, photographic material samples Nos. 104 to 119, to which the water-soluble polymer (P-1), (P-3), (P-5), (P-10) or (P-11) of the present invention had been added, had almost no roller marks and a drying property which is sufficient on a practical level. Due to the addition of the water-soluble polymer of the present invention, the sensitivity of the samples increased. The other comparative photographic material samples Nos. 120 to 123, to which polyacrylic acid had been added, did not display an improvement of the drying property or an improvement of the resistance to roller marks. As shown in the results, several of the unexpectedly superior properties of the present invention have been demonstrated.

EXAMPLE 2

Preparation of Tabular Silver Halide Grains:

4.5 g of potassium bromide, 12.0 g of gelatin and 2.5 cc of a 5% aqueous solution of thioether, $HO(CH_2)_2S(CH_2)_2S(CH_2)_2OH$, were added to one liter of water in a container, which was kept at 55° C. 37 cc of an aqueous solution of silver nitrate (silver nitrate content: 3.43 g) and 33 cc of an aqueous solution containing 2.97 g of potassium bromide and 0.363 g of potassium iodide were added there to, with stirring, by a double jet method over a period of 37 seconds. Next, an aqueous solution of 0.9 g of potassium bromide was added thereto, and the reaction mixture was heated up to 70° C. Then, 53 cc of a solution of silver nitrate (silver nitrate content: 4.90 g) was added thereto over a period of 13 minutes. 8 cc of 25% aqueous ammonia was added thereto. The mixture was physically ripened at the temperature for 10 minutes,, and 7 cc of 100% acetic acid solution was added thereto. Subsequently, an aqueous solution of 133.3 g of silver nitrate and an aqueous solution of potassium bromide were added thereto, at a pAg of 8.5, by a controlled double jet method over a period of 35 minutes. Next, 10 cc of 2N potassium thiocyanate solution and 0 05 mol % based on the total silver amount, of fine AgI grains having a diameter of 0.07 μm were added thereto. The mixture was physically ripened for 5 minutes at the temperature, and then cooled to 35° C. Thus, monodispersed tabular grains were obtained, having a total silver iodide content of 0.31 mol %, a mean projected area diameter of 0.61 μm, a thickness of 0.120 μm and a fluctuation coefficient of diameter of 16.5%.

Soluble salts were removed from the emulsion by flocculation. The emulsion was heated again up to 40° C., and 30 g of gelatin, 2.35 g of phenoxyethanol and, as a thickener, 0.8 g of sodium polystyrenesulfonate were added thereto. The resulting emulsion was adjusted to have a of 5.90 and a pAg of 7.90 with sodium hydroxide and silver nitrate solution.

The emulsion was then chemically sensitized with stirring at 56° C.

That is 0.043 mg of thiourea dioxide was added to the emulsion, which was then maintained for 22 minutes to achieve reduction sensitization. Next, 250 mg of sensitizing dye (I-1), as used in Example 1, was added thereto. Subsequently, sodium thiosulfate and the following selenium sensitizing dye were added thereto in a molar ratio of 6/4.

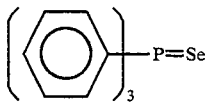

Subsequently, chloroauric acid and potassium thiocyanate were added to the emulsion, which was then cooled 35° C. after 40 minutes. Accordingly, tabular grains (A-2) were prepared.

Preparation of coating liquid for emulsion layer:

The following chemicals were added to tabular grains (A-2) to form a coating liquid, the amounts of the chemicals being per mol of silver halide of the emulsion.

| | |
|---|---|
| 2,6-Bis(hydroxyamino)-4-diethylamino-1,3,5-triazine | 72 mg |
| Gelatin | Shown in Table 3 |
| Water-soluble polymer of the invention | Shown in Table 3 |
| Sodium polystyrenesulfonate (mean molecular weight: 600,000) | 1.8 g |
| 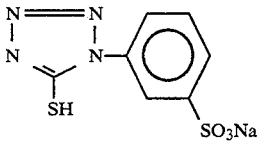 | 50 mg |
| 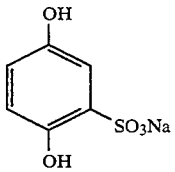 | $4 \times 10^{-2}$ mol/mol of AgI |
| 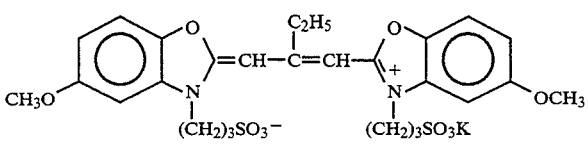 | 150 mg |
| 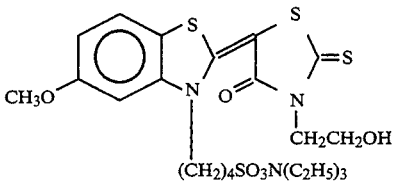 | 100 mg |
| 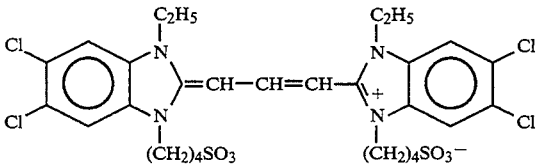 | 2.5 mg |
| Snowtex C (produced by Nissan Chemical Co.) | 9.6 g as solid content |

Preparation of coating liquid for surface protective layer:

A coating liquid for coating a surface protective layer for protecting the emulsion layer was prepared, comprising the components mentioned below.

| | |
|---|---|
| Gelatin | Shown in Table 3 |
| Water-soluble polymer of the invention | Shown in Table 3 |
| 4-Hydroxy-6-methyl-1,3,3a,7-tetrazaindene | 0.003 g/m$^2$ |
| Polymethyl methacrylate (mean grain size: 2.5 μm) | 0.05 g/m$^2$ |
| Proxel | 0.0005 g/m$^2$ |
| $C_8F_{17}SO_2N(C_3H_7)(CH_2CH_2O)_4(CH_2)_4SO_3Na$ | 0.0006 g/m$^2$ |
| $C_8F_{17}SO_2N(C_3H_7)(CH_2CH_2O)_{15}H$ | 0.0009 g/m$^2$ |

-continued

| | |
|---|---|
| 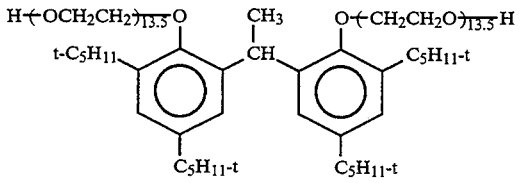 | 35 mg/m$^2$ |
| 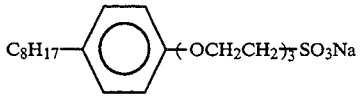 | 0.012 g/m$^2$ |
| $C_8F_{17}SO_3K$ | 0.003 g/m$^2$ |

Preparation of support:

One surface of a biaxially stretched polyethylene terephthalate film having a thickness of 183 μm, which had previously been coated with a subbing layer, was coated with the previously prepared emulsion layer-coating liquid and surface protective layer-coating liquid by co-extrusion. The silver amount coated was adjusted to be 2.55 g/m$^2$. The polyethylene terephthalate film contained 0.04% by weight of the same dye as in the film substrate employed in Example 1.

Formation of anti-halation layer:

An anti-halation layer was coated on the other surface of the film support opposite to that coated with the previous emulsion layer and protective layer, and a surface protective layer was coated over the anti-halation layer. The layers comprised the following components.

| Anti-halation layer: | |
|---|---|
| Gelatin | 1.5 g/m$^2$ |
| Phosphoric acid | 5.2 g/m$^2$ |
| Snowtex C (produced by Nissan Chemical Co.) | 0.5 g/m$^2$ as solid content |
| Potassium polystyrenesulfonate (mean molecular weight: 600,000) | 25 mg/m$^2$ |
| Polymer latex (poly(ethylacrylate/methacrylic acid = 97/3) | 0.53 g/m$^2$ |
| 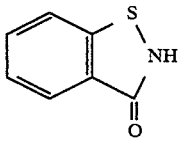 | 4.2 mg/m$^2$ |
| $CH_2{=}CHSO_2CH_2CH(OH)CH_2SO_2CH{=}CH_2$ | 40 mg/m$^2$ |
| 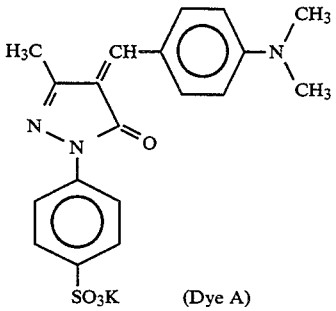 (Dye A) | 75 g/m$^2$ |
| 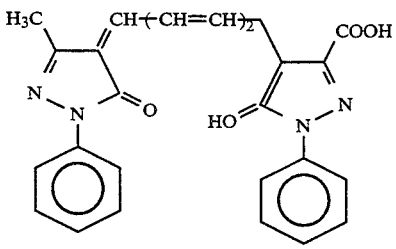 (Dye B) | 50 g/m$^2$ |

-continued

| | |
|---|---|
| 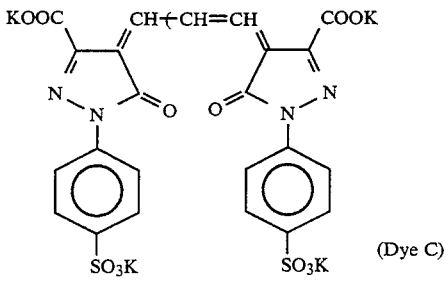 (Dye C) | 50 g/m$^2$ |
| Protective layer of protecting anti-halation layer: | |
| Gelatin | 1.05 g/m$^2$ |
| Polymethyl methacrylate (mean diameter: 3.5 μm) | 65 mg/m$^2$ |
| 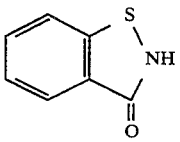 | 1.3 mg/m$^2$ |
| $C_{16}H_{33}O(CH_2CH_2O)_{10}H$ | 40 mg/m$^2$ |
| 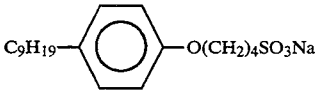 | 13 mg/m$^2$ |
| $C_8F_{17}SO_3K$ | 1.7 mg/m$^2$ |
| Potassium polystyrenesulfonate (mean molecular weight: 600,000) | 2 mg/m$^2$ |
| NaOH | 2.5 mg/m$^2$ |

The anti-halation layer and the protective layer were formed by co-extrusion and dried.

The photographic material samples thus prepared were tested by the same methods as those in Example 1, and the test results obtained are shown in Table 4 below.

TABLE 3

| Photographic Material Sample | Water-soluble Polymer of the Invention | Amount of Water-soluble Polymer (g/m$^2$) | | Amount of Gelatin (g/m$^2$) | |
|---|---|---|---|---|---|
| | | Surface Protective Layer | Emulsion Layer | Surface Protective Layer | Emulsion Layer |
| 201 (Comparison) | No | — | — | 1.17 | 1.53 |
| 202 (Comparison) | No | — | — | 1.17 | 2.03 |
| 203 (Comparison) | No | — | — | 1.17 | 2.23 |
| 204 (Invention) | P-3 | 0.032 | — | 1.138 | 2.03 |
| 205 (Invention) | P-3 | 0.128 | — | 1.042 | 2.03 |
| 206 (Invention) | P-3 | 0.320 | — | 0.850 | 2.03 |
| 207 (Invention) | P-3 | 0.640 | — | 0.530 | 2.03 |
| 208 (Invention) | P-3 | 0.640 | 0.320 | 0.530 | 1.73 |
| 209 (Invention) | P-5 | 0.032 | — | 1.138 | 2.03 |
| 210 (Invention) | P-5 | 0.128 | — | 1.042 | 2.03 |
| 211 (Invention) | P-5 | 0.320 | — | 0.850 | 2.03 |
| 212 (Invention) | P-5 | 0.640 | — | 0.530 | 2.03 |
| 213 (Invention) | P-5 | 0.640 | 0.320 | 0.530 | 1.73 |
| 214 (Invention) | P-1 | 0.320 | — | 0.850 | 2.03 |
| 215 | P-3 | 0.320 | — | 0.850 | 2.03 |

TABLE 3-continued

| Photographic Material Sample | Water-soluble Polymer of the Invention | Amount of Water-soluble Polymer (g/m²) | | Amount of Gelatin (g/m²) | |
|---|---|---|---|---|---|
| | | Surface Protective Layer | Emulsion Layer | Surface Protective Layer | Emulsion Layer |
| (Invention) 216 | P-12 | 0.320 | — | 0.850 | 2.03 |
| (Invention) 217 | P-14 | 0.320 | — | 0.850 | 2.03 |
| (Invention) 218 | P-3 | — | 0.320 | 1.17 | 1.83 |
| (Invention) 219 | P-5 | — | 0.320 | 1.17 | 1.83 |
| (Invention) 220 | polyacrylic acid | 0.032 | — | 1.143 | 2.03 |
| (Comparison) 221 | polyacrylic acid | 0.320 | — | 0.846 | 2.03 |
| (Comparison) 222 | polyacrylic acid | 0.640 | 0.320 | 0.530 | 1.73 |
| (Comparison) 223 | polyacrylic acid | — | 0.320 | 1.17 | 1.83 |
| (Comparison) | | | | | |

TABLE 4

| Photographic Material Sample | Swelling Rate with Distilled Water (%) | Swelling Rate after Development (%) | Swelling Rate after Rinsing (%) | Sensitivity | Resistance to Roller Marks | Drying Property |
|---|---|---|---|---|---|---|
| 201 (Comparison) | 230 | 230 | 250 | 108 | D | C |
| 202 (Comparison) | 230 | 230 | 250 | 100 | C | D |
| 203 (Comparison) | 230 | 230 | 255 | 97 | B | D |
| 204 (Invention) | 230 | 235 | 230 | 100 | B | B |
| 205 (Invention) | 230 | 240 | 220 | 102 | A | B |
| 206 (Invention) | 230 | 245 | 210 | 108 | A | A |
| 207 (Invention) | 230 | 250 | 190 | 112 | A | A |
| 208 (Invention) | 230 | 270 | 160 | 120 | A | A |
| 209 (Invention) | 230 | 237 | 225 | 102 | B | B |
| 210 (Invention) | 230 | 245 | 220 | 107 | A | B |
| 211 (Invention) | 230 | 250 | 205 | 112 | A | A |
| 212 (Invention) | 230 | 260 | 185 | 117 | A | A |
| 213 (Invention) | 230 | 280 | 160 | 127 | A | A |
| 214 (Invention) | 230 | 235 | 205 | 108 | A | A |
| 215 (Invention) | 230 | 235 | 210 | 110 | A | A |
| 216 (Invention) | 230 | 235 | 205 | 108 | A | A |
| 217 (Invention) | 230 | 235 | 210 | 110 | A | A |
| 218 (Invention) | 230 | 240 | 200 | 113 | A | A |
| 219 (Invention) | 230 | 240 | 195 | 115 | A | A |
| 220 (Comparison) | 230 | 230 | 250 | 100 | C | D |
| 221 (Comparison) | 230 | 230 | 260 | 100 | C | D |
| 222 (Comparison) | 230 | 230 | 270 | 100 | C | C |
| 223 (Comparison) | 230 | 230 | 300 | 100 | C | C |

As shown in Table 4 above, photographic material sample No. 201 had poor resistance to roller marks, and is not suitable on a practical level. Photographic material samples Nos. 202 and 203 had a poor drying property and are not durable for practical use when applied to an ultra-rapid processing system. In contrast, photographic material samples Nos. 204 to 219, to which the water-soluble polymer (P-1), (P-3), (P-5), (P-12) or (P-14) of the present invention had been added, had almost no roller marks and a drying property which is sufficient on a practical level. Due to addition of the water-soluble polymer of the present invention, the sensitivity of the samples increased. The other comparative photographic material samples Nos. 220 to 223, to which polyacrylic acid had been added, did not display an improvement of the drying property or an improvement of the resistance to roller marks. As shown in the results, several of the unexpectedly superior properties of the present invention have been shown.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising, on a support, at least one silver halide layer and at least one hydrophilic colloid layer, wherein the hydrophilic colloid layer consists essentially of gelatin and a water-soluble polymer comprising at least one COOH-containing monomer or a salt thereof which is water-insoluble at a pH$\leqq$6 and water-soluble at a pH$\geqq$10, wherein a polymer ratio of said water-soluble polymer to gelatin coated on one surface of said support, which has a value of 0.01 to 0.3, is represented by the following equation:

$$\text{Polymer ratio} = (\text{amount of water-soluble polymer coated})/(\text{amount of water-soluble polymer coated} + \text{amount of gelatin coated}).$$

2. The silver halide photographic material as in claim 1, wherein the water-soluble polymer is present on the side of the support on which the silver halide emulsion layer is coated, and the photographic material meets the following requirement when the material is processed for 8 seconds for development, 7 seconds for fixation and 7 seconds for rinsing with a developer and a fixer which are both substantially free of a hardening agent:

a ratio of a swelling rate of the material after rinsing to a swelling rate of the material after development is 1.0 or less.

3. The silver halide photographic material as in claim 1, wherein the photographic material meets the following requirement when the material is processed for 8 seconds for development, 7 seconds for fixation and 7 seconds for rinsing, with a developer and a fixer which are both substantially free of a hardening agent:

a ratio of a swelling rate of the material after rinsing to a swelling rate of the material in distilled water is 1.0 or less, wherein the swelling rate of the material in distilled water is a conversion of the thickness of the material which has been incubated at 40° C. and 60% relative humidity for 16 hours and then dipped in distilled water having a temperature of 21° C. for 3 minutes.

4. The silver halide photographic material as in claim 1, wherein a dry-to-dry processing time for developing the material from start to finish is 60 seconds or less.

5. The silver halide photographic material as in claim 1, wherein the weight average molecular weight of the water-soluble polymer is $5\times10^3$ or more.

6. The silver halide photographic material as in claim 5, wherein the weight average molecular weight is $1\times10^4$ to $5\times10^6$.

7. The silver halide photographic material as in claim 1, wherein the water-soluble polymer is present in an amount of from 0.01 g/m$^2$ to 2 g/m$^2$.

8. The silver halide photographic material as in claim 7, wherein the amount is from 0.03 g/m$^2$ to 1 g/m$^2$.

9. The silver halide photographic material as in claim 7, wherein the amount is from 0.05 g/m$^2$ to 0.5 g/m$^2$.

10. The silver halide photographic material as in claim 1, wherein the water-soluble polymer comprises two or more different COOH-containing monomers or salts thereof which are copolymerized.

11. The silver halide photographic material as in claim 1, wherein the COOH-containing monomer or salt thereof is copolymerized with at least one ethylenically unsaturated monomer.

12. The silver halide photographic material as in claim 1, wherein the hydrophilic colloid layer containing the water-soluble polymer is a silver halide emulsion layer.

13. The silver halide photographic material as in claim 1, wherein the water-soluble polymer is coated in the form of an aqueous solution in which the water-soluble polymer is dissolved.

* * * * *